US005111010A

United States Patent [19]

Kokubu et al.

[11] Patent Number: 5,111,010

[45] Date of Patent: May 5, 1992

[54] SWITCH DEVICE

[75] Inventors: Sadao Kokubu; Minoru Nishio; Yoshitaka Hattori, all of Aichi, Japan

[73] Assignee: Kabushiki Kaisha Tokai-Rika-Denki-Seisakusho, Aichi, Japan

[21] Appl. No.: 500,562

[22] Filed: Mar. 28, 1990

[30] Foreign Application Priority Data

Mar. 31, 1989 [JP] Japan ..... 1-38425[U]

[51] Int. Cl.[5] ..... H01H 5/18

[52] U.S. Cl. ..... 200/461; 200/283; 29/622

[58] Field of Search ..... 200/459, 460, 461, 408, 200/409, 406, 283, 452, 445, 449, 450, 453; 29/622

[56] References Cited

U.S. PATENT DOCUMENTS

| | | | |
|---|---|---|---|
| 3,244,848 | 4/1966 | Chapin et al. | 200/461 X |
| 3,476,898 | 11/1969 | Ehrenfels et al. | 200/461 |
| 3,513,274 | 5/1970 | Jullien-Davin | 200/461 |
| 3,857,003 | 12/1974 | Nishio et al. | 200/409 |

FOREIGN PATENT DOCUMENTS

| | | | |
|---|---|---|---|
| 657134 | 10/1963 | Italy | 200/406 |
| 640097 | 7/1950 | United Kingdom | 200/406 |

*Primary Examiner*—Henry J. Recla
*Assistant Examiner*—Glenn T. Barrett
*Attorney, Agent, or Firm*—Sixbey, Friedman, Leedom & Ferguson

[57] ABSTRACT

Two leaf springs of substantially identical width which define first and second movable members are superposed on each other at one end and connected together. A movable contact is attached to the thus connected portion. The first movable member has a slot formed in a middle portion thereof. The width of an end portion of the second movable member is set so that the end portion can be inserted in the slot. A supporting member being inserted in the slot has a portion for swingably supporting an edge portion of the slot and another portion for swingably supporting an end portion of the second movable member opposite to the movable contact. The second movable member is curved so that upon application of a operating force to the first movable member the urging direction of the second movable member changes to cause a snap action to thereby selectively bring the movable contact into contact with one of the two fixed contacts. The width of the second movable member can be increased irrespective of the size of the slot, thus making it possible to provide a large urging force.

23 Claims, 12 Drawing Sheets

SWITCH DEVICE

BACKGROUND OF THE INVENTION

1. Field of the Invention

The present invention relates to a switch device of the type wherein a movable contact portion is connected to and disconnected from a fixed contact portion by the snap action of a movable member of a leaf spring structure.

2. Background Information

FIGS. 19 through 21 show a conventional switch device used in automobile window regulators.

In these drawings, 1 is a movable member of a leaf spring structure with a rectangular shape. Formed therein is a substantially rectangular slot 3 and a curved spring portion 2 extending downward. This movable member 1 has a movable contact 4 provided in its free end portion and a notch-like pivot portion 5 formed in its base end portion. Another notch-like pivot portion 6 is formed in a distal end portion of the spring portion 2. 7 is a switch casing on which a terminal board 10 is provided that has first and second support portions 8 and 9 spaced horizontally from each other. This switch casing 7 further has fixed contacts all and 12 spaced vertically from each other. The movable member 1 is accommodated in the casing 7 such that the pivot portion 5 of the base end portion is fitted in and supported by the first support portion 8 and the pivot portion 6 of the spring portion 2 by the second support portion 9.

In the state of FIG. 20, since the free end portion of the movable member 1 is applied with an obliquely-upward urging force from the spring force of the spring portion 2, the movable contact 4 is kept in contact with the fixed contact 11 on the closed side. As shown in FIG. 21, however, when the base end portion of the movable member 1 is depressed downward by a control member 13 so that arm portions 14 of the movable member 1 are moved downward beyond the pivot portion 6 of the spring portion 2, the free end portion of the movable member 1 is applied with an obliquely-downward urging force from the spring portion 2. Consequently, the free end portion of the movable member 1 is quickly moved downward by a downward component of the urging force, so that the movable contact 4 is disconnected from the fixed contact 11 on the normally closed side and brought into contact with the fixed contact 12 on the open side. Upon contact of the movable contact 4 with the fixed contact 12 on the open side, a window regulator motor is energized, so that a window is moved up or down.

In the foregoing structure of the prior art, to cause switching such that the movable contact 4 comes to contact with the fixed contact 12 on the open side, a portion of the movable member 1 corresponding to the second support portion 9 must be located below the pivot portion 6 of the spring portion 2 when the movable member 1 is depressed by the control member 13 in order to cause a snap action. Therefore, a slot 3 is needed in the movable member 1 since in the foregoing depressed state the second support portion 9 must penetrate through the movable member 1. With such a configuration, electric current for the motor of the window regulator flows through the arm portion 14 and spring portion 2 of the movable member 1. However, in order to increase the current capacity of the switch device, the width W of the movable member 1 must be increased in order to increase the width of the arm portion 14. Further, to increase the contact pressure of the movable contact 4 with respect to the fixed contacts 11 and 12, the width of the spring portion 2 must be increased, thus increasing the width W of the movable member 1. As a result, there is the problem of the overall size of the switch device becoming large.

SUMMARY OF THE INVENTION

It is an object of the present invention to provide a switch device of the snap action type which is large in capacity, small in size and yet is able to provide sufficient contact pressure between a movable contact portion and a fixed contact portion.

According to the present invention, to cause snap action, first and second leaf springs are made substantially identical in width and superposed onto each other at one free end. These leaf springs have pivot portions at the base portion that are opposite to the thus superposed portions and are adapted to be fitted to a supporting member. The supporting member is inserted into a slot formed in a middle portion of the first leaf spring. The pivot portion (as edge portion of the slot) of the first leaf spring is pressed against one side of the supporting member. The pivot portion (a base end portion) of the second leaf spring is pressed against the other side of the supporting member. The second leaf spring is resiliently curved, and when an operating forced is applied to the first leaf spring, the urging direction of the second leaf spring is changed to cause snap action. Since the width of the second leaf spring may be increased irrespective of the size of the slot of the first leaf spring, the urging force of the second leaf spring acting on a movable contact with respect to fixed contacts may be increased.

DESCRIPTION OF THE PREFERRED EMBODIMENTS

A switch device adapted for use in an automobile window regulator, according to a first embodiment of the present invention will be described below with reference to FIGS. 1 through 6.

Figure 1:
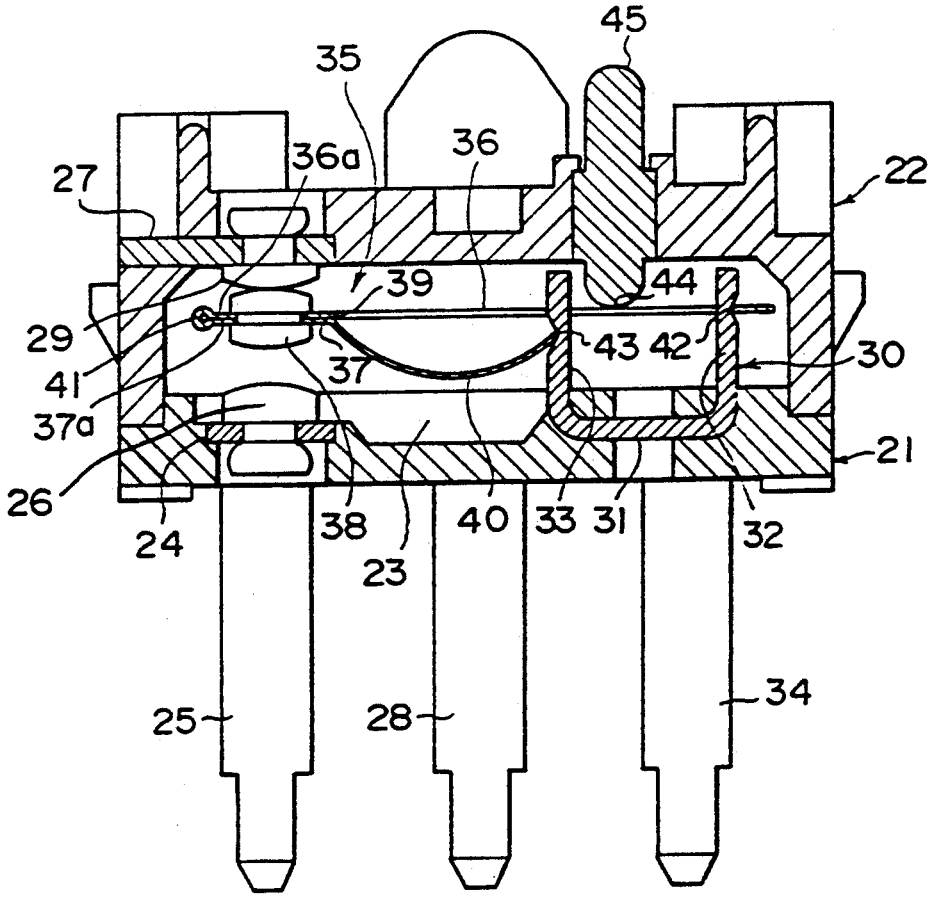
FIG. 1 is a sectional view showing a switch device according to a first embodiment of the present invention.

In FIG. 1, a switch body is formed by attaching a rectangular casing 22, made of an insulating material and having a hollow portion formed on its bottom side, to the upper side of a rectangular base member 21 of insulating material. The base member 21 has a hollow portion 23 formed on its upper side. A fixed contact conductor 24 is provided in the base member 21 by insert molding, which has a terminal member 25 projecting downward therefrom. The fixed contact conductor 24 is exposed to the inside of the hollow portion 23, whose exposed portion has a columnar fixed contact 26 (on the open side) secured thereto.

A fixed contact conductor 27 provided in the casing 22 by insert molding has a terminal member 28 projecting downward from the base member 21. A portion of the fixed contact conductor 27 is exposed from the bottom surface of the casing 22 so as to face the fixed contact 26, this exposed portion having a columnar fixed contact 29 (on the closed side) secured thereto.

Figure 5:
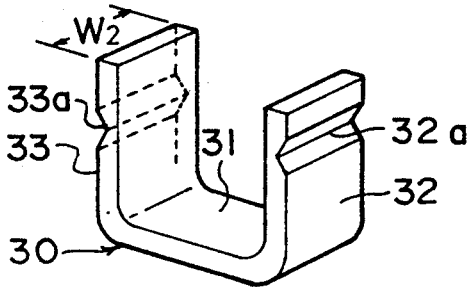
FIG. 5 is a perspective view of a supporting member.
Figure 6A:
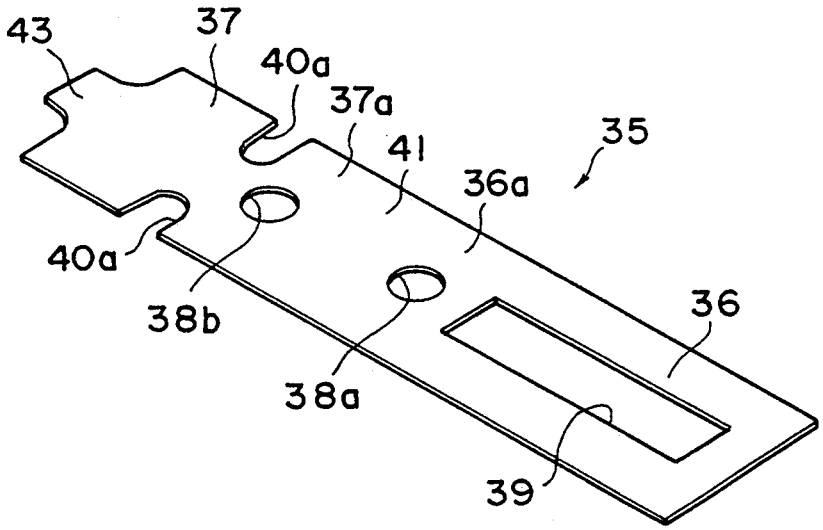
FIG. 6(A) is a development of a leaf spring.
Figure 6B:
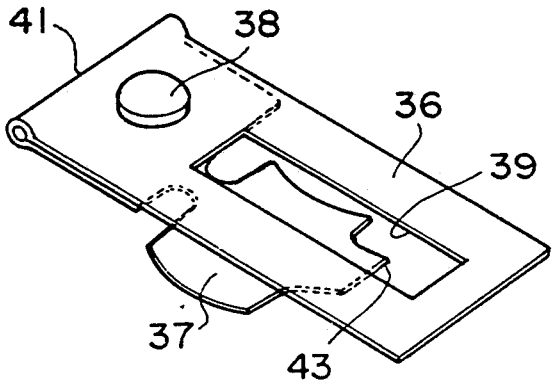
FIG. 6(B) is a perspective view showing the leaf spring of FIG. 6(A)

A terminal body 30 formed by bending a conductive plate into a substantial U-shape has a base portion 31 secured in the base member 21 by insert molding. First and second support portions 32 and 33 extend orthogonally from the base portion 31 toward the casing 22. In FIG. 5, the first support portion 32 has a notch-like V-shaped lock portion **32*a* extending in the traverse direction. The second support portion 33 also has a notch-like V-shaped lock portion 33*a* extending in the traverse direction. The lock portion 33*a* of the second support portion 33 is located below the lock portion 32*a* of the first support portion 32 (i.e. closer to the base portion 31 than the lock portion 32*a*). The terminal body 30 is connected with a terminal member 34 (see FIG. 1) projecting downward from the base member 21**.

Figure 2:
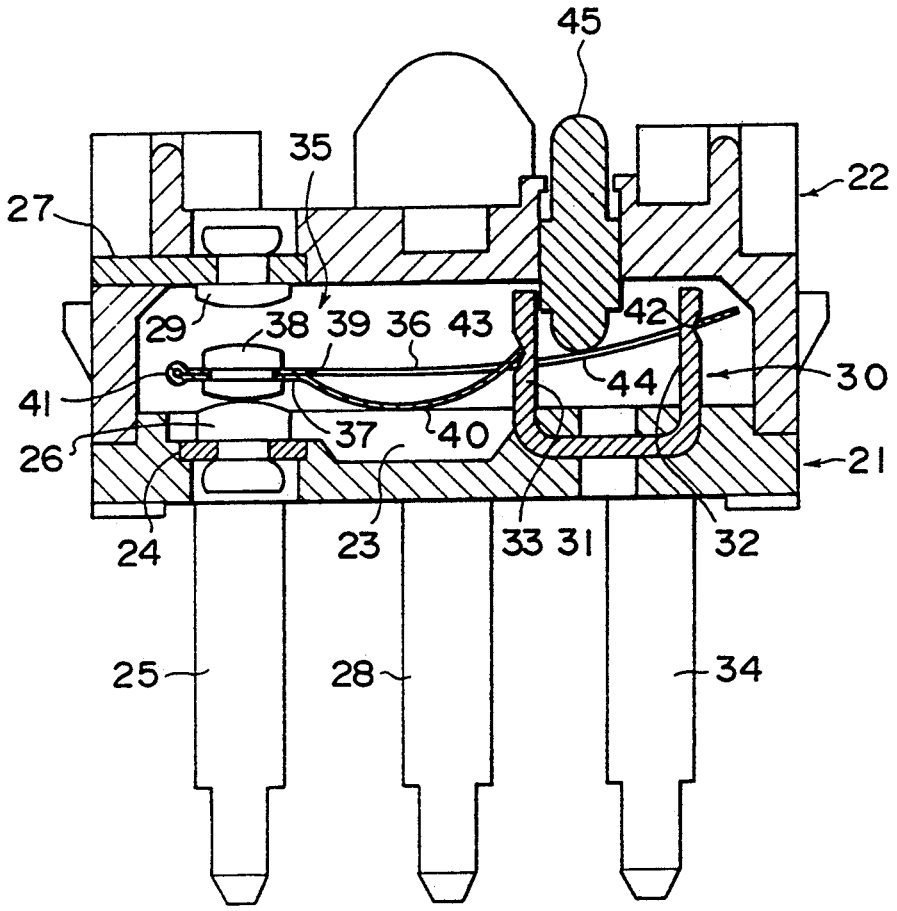
FIG. 2 is a sectional view showing the switch device of FIG. 1 after being switched.
Figure 3:
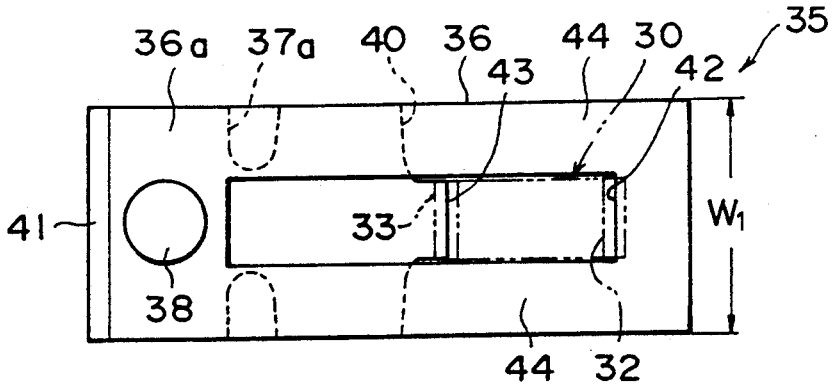
FIG. 3 is a plan view of a movable member with a movable contact.
Figure 4:
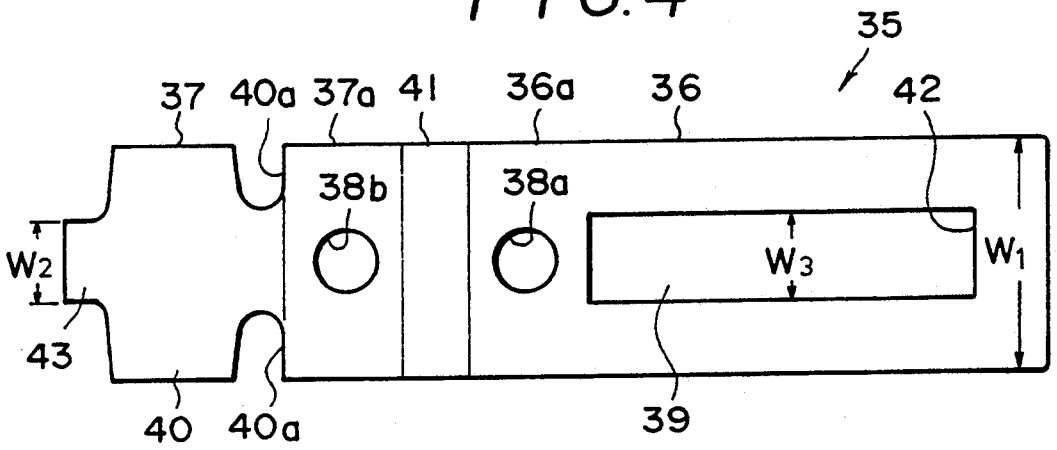
FIG. 4 is a development showing the movable member of FIG. 3.

In FIGS. 3 and 4, a movable contact plate 35 is of a leaf spring structure, which has first and second movable member 36 and 37 connected together by a connecting portion 41. End portions **36*a* and 37*a* are adjacent to the connecting portion 41 and have circular holes 38*a* and 38*b* formed respectively therein to which a columnar movable contact 38 is secured. The first movable member 36 has a rectangular slot 39 formed in a laterally central portion thereof. As shown in FIGS. 1 and 2, a middle portion of the second movable member 37 is curved so as to be convex with respect to the base member 21, defining a curved portion 40**.

As shown in FIG. 4, the movable contact plate 35 having the first and second movable members 36 and 37 connected together by the connecting portion 41 in the form of a single elongate body is fabricated by subjecting a leaf spring board to stamping.

Figure 19:
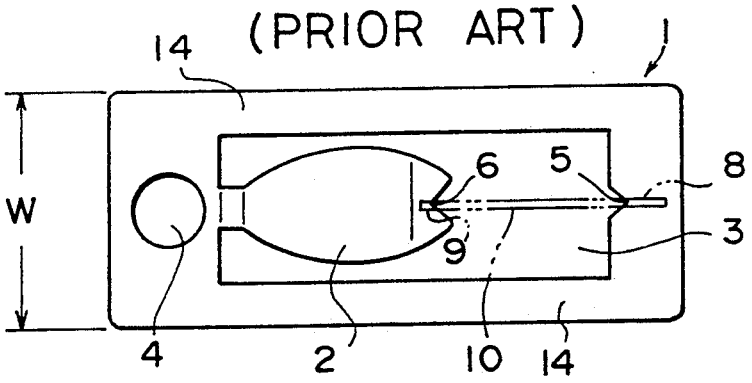
FIG. 19 (PRIOR ART)
FIG. 19 is a plan view showing a movable member or leaf spring of a conventional switch device.
Figure 20:
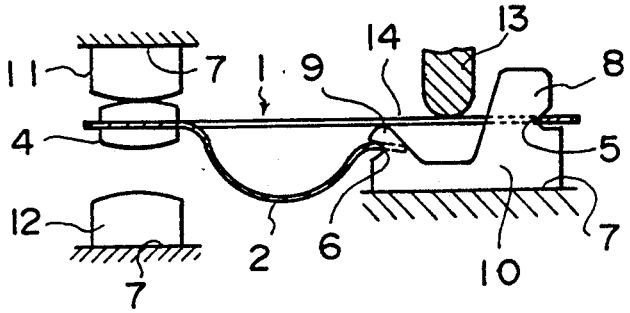
FIG. 20 (PRIOR ART)
FIG. 20 is a sectional view of the conventional switch device.
Figure 21:
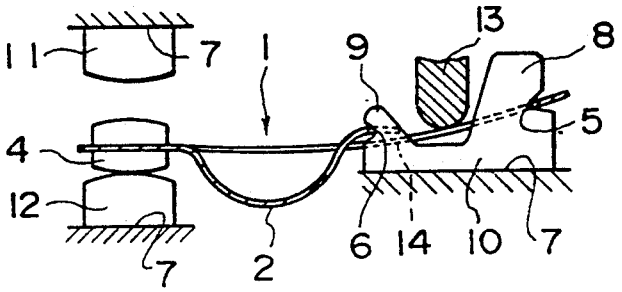
FIG. 21 (PRIOR ART)
FIG. 21 is a sectional view showing the conventional switch device after being switched.

With regard to the dimensions, the width $W_1$ of the first and second movable members 36 and 37 is identical with the width W (FIG. 19) of the movable member 1 in the prior art ($W_1 = W$). The width of a straight pivot portion 43 at a base end portion is identical with the width of the terminal body 30 ($W_2$). The width $W_3$ of the slot 39 is slightly larger than the width $W_2$. That is, the width $W_2$ of the pivot portion 43 which is a straight portion of a base end portion of the second movable member 37 is smaller than the width of other portions, particularly, smaller than the width of the curved portion 40.

After stamping, the curved portion 40 is formed by bending, and the connecting portion 41 is folded to obtain a superposed state. A straight pivot portion 42 of a base end portion of the first movable member 36 which is a right-side edge portion of the rectangular slot 39 is swingably fitted to the lock portion **32*a* of the first support portion 32 of the terminal body 30. Similarly, the straight pivot portion 43 of the second movable member 37 is swingably fitted to the lock portion 33*a* of the second support portion 33. As a result, a compressive force is lengthwisely generated in the second movable member 37, and a tensile force is lengthwisely generated in the first movable member 36**.

Therefore, as shown in FIG. 1, when the first movable member 36 is located above the pivot portion 43 the end portions **36*a* and 37*a* of the movable contact plate 35 are urged in the left upward direction by the tensile force of the curved portion 40 of the second movable member 37, so that the movable contact 38 is kept in contact with the fixed contact 29 on the closed side with a certain contact pressure. A base end portion 44 of the first movable member 36 is adapted to be contacted with a control member 45 provided in the casing 22. In this way, a switch section is composed of the movable contact plate 35 with the movable contact 38, the fixed contact 26 on the open side, and the fixed contact 29** on the closed side.

As shown in FIG. 4, two notches **40*a* are formed between the curved portion 40 and the end portion 37*a* to facilitate flexure of the curved portion 40**.

Next, the operation of the first embodiment will be described.

In FIG. 1, the end portions **36*a* and 37*a* of the movable contact plate 35 are normally applied with an urging force in the left upward direction from the curved portion 40 of the second movable member 37 that exerts a spring force, so that the movable contact 38 is kept in contact with the fixed contact 29 on the closed side by an upward component of the urging force. In this state, when a knob (not shown) provided in an upper section of the casing 22 is controlled to depress the control member 45 downward, the base end portion 44 of the first movable member 36 of the movable contact plate 35 deforms and curves downward. When the base end portion 44 of the first movable member 36 comes below the lock position (corresponding to the lock portion 43) at which the pivot portion 43 of the second movable member 37 is fitted to the second support portion 33, the end portions 36*a* and 37*a* of the movable contact plate 35 are applied with an urging force in the left downward direction from the curved portion 40 of the second movable member 37 that exerts a tensile spring force. Consequently, the end portions 36***a* and 37*a* move quickly downward to cause a snap action, whereby the movable contact 38 separates from the fixed contact 29 on the closed side and comes to contact with the fixed contact 26 on the open side, leading to the state shown in FIG. 2. On the contrary, when the depressive force of the knob is removed from the control member 45, the first movable member 36 of the movable contact plate 35 recovers by virtue of its spring force, and the base end portion 44 comes above the pivot portion 43 of the second movable member 37. As a result, the end portions 36*a* and 37*a* are applied with an urging force in the left upward direction from the curved portion 40 of the second movable member 37 that exerts a tensile force, so that the end portions 36*a* and 37*a* move quickly upward to cause a snap action, whereby the movable contact 38 separates from the fixed contact 26 on the open side and comes to contact with the fixed contact 29 on the closed side, restoring it to the state shown in FIG. 1. When the movable contact 38 comes in contact with the fixed contact 26 on the open side, the motor of the window regulator is energized, so that a window is moved up or down. When such contact is removed, the window stops.

The foregoing first embodiment has the following advantages. The width $W_3$ of the slot 39 of the first movable member 36 may be decreased as much as possible. This suppressing a decrease in the capacity of current resulting from the presence of the slot 39. Therefore, the switch device can have a large current capacity despite its size without increasing the width $W_1$ of the movable members 36 and 37.

The width of the curved portion 40 of the second movable member 37 cannot be limited by the width $W_3$ of the slot 39 of the first movable member 36, but may be made identical with the width $W_1$, for example. Therefore, the contact pressure of the movable contact 38 with respect to the fixed contacts 26 and 29 can be made sufficiently large. Further, since the width of the curved portion 40 which tends to heat up upon current flowing can be increased, its temperature rise can be suppressed.

Since the terminal body 30 has the first and second support portions 32 and 33 which are fabricated by bending a conductive plate into a substantial U-shape, the pivot portions 42 and 43 of the first and second movable members 36 and 37 can be kept in line contact with the lock portions 32*a* and 33*a* of the first and second support portions 32 and 33; therefore, contrarily to the prior art, the amount of heating due to current concentration can be decreased.

Compared to the case in which the first and second movable members 36 and 37 are combined into a single body after being separately fabricated, the fabrication of the movable contact plate is easy and the number of parts is small. The conductivity in the end portions 36*a* and 37*a* of the first and second movable members 36 and 37 is enhanced; therefore, the amount of heating due to current concentration can be reduced.

Figure 7:
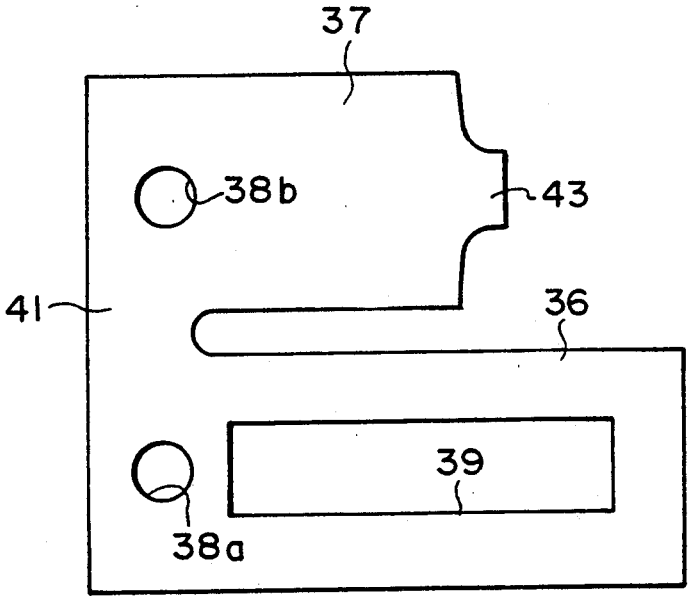
FIG. 7 is a plan view showing a leaf spring according to a second embodiment of the present invention.
Figure 8:
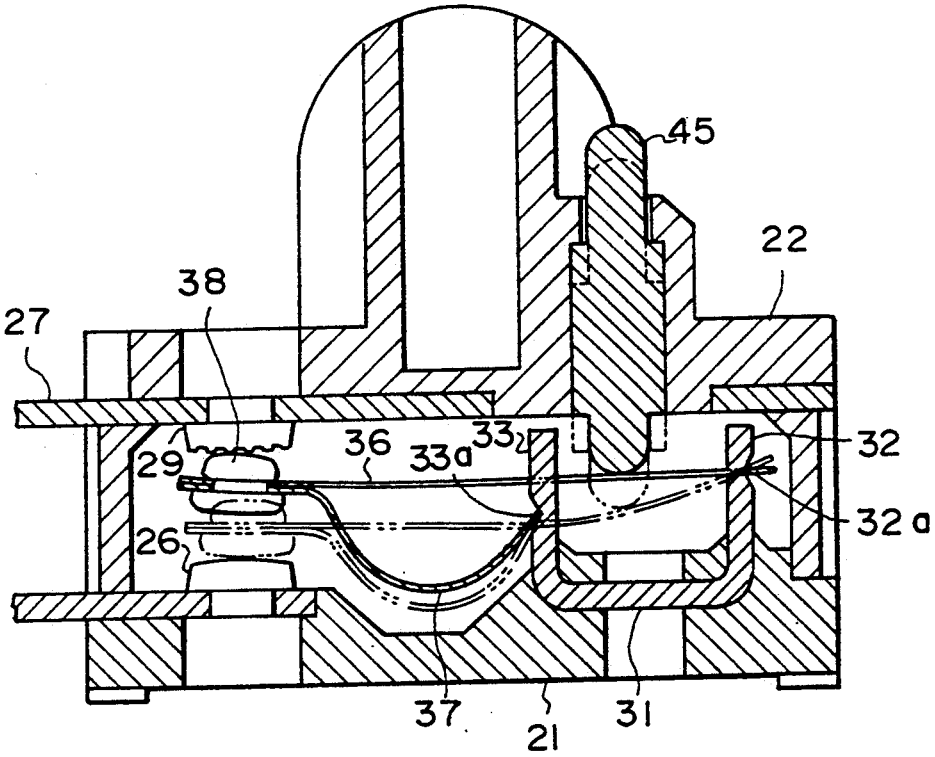
FIG. 8 is a sectional view showing a switch device according to a third embodiment of the present invention.

Although the first embodiment shows the first and second movable members 36 and 37 being connected together by the connecting portion 41 in the form of a single elongate body, as shown in FIG. 7, the first and second movable members 36 and 37 may be arranged side by side and connected together by the connecting portion 41 in accordance with a second embodiment of the present invention.

Further, the present invention has been described as being applied to the switch device of a window regulator, but it can be applied to various types of switch devices.

A third embodiment of the present invention will be described with reference to FIGS. 8 through 16.

In this embodiment, the first and second movable members 36 and 37 are independently fabricated from separate leaf spring materials. That is, the first movable member 36 has a long slot 52 and a short slot 54 adjacent thereto and a connecting portion 56 therebetween. This connecting portion 56 corresponds with the control member 45. The end portion 36*a* of the first movable member 36 and the end portion 37*a* of the second movable member 37 are superposed and secured together by the movable contact 38 which is a rivet.

The second movable member 37 is substantially identical in width with the first movable member 36, and has a pair of notches 40*a* formed in a middle portion thereof as is the case of the first embodiment. The pivot portion 43 of the second movable member 37 is narrower than the long slot 52. Since the second movable member 37 is fabricated independently of the first movable member 36, it may be made of a different material, and its thickness may be made thicker than the first movable member 36.

To prevent the first and second movable members 36 and 37 from rotating separately about the movable contact 38, a coupling means 60 is provided in the end portions 36*a* and 37*a*. Specifically, the coupling mean 60 includes folded portions 57 and 58 which are formed by partly cutting the end portions 36*a* and 37*a* of the first and second movable members 36 and 37 along shear faces 57*a* and 58*a* and then folding under to a state in which the end portion 36*a* is superposed on the end portion 37*a*. Consequently, the folded portions 57 of the first movable member 36 are engaged with the shear faces 58*a* of the second movable member 37. Therefore, even when an external force is applied to the movable members 36 and 37, tending to cause them to rotate about the movable contact 38 separately in the directions of the arrow R (FIG. 12), the folded portions 57 are blocked by the shear faces 58*a*, preventing separate rotation of the movable members 36 and 37. That is, the first and second movable members 36 and 37 are clamped together by the folded portions 57 and 58.

Figure 13:
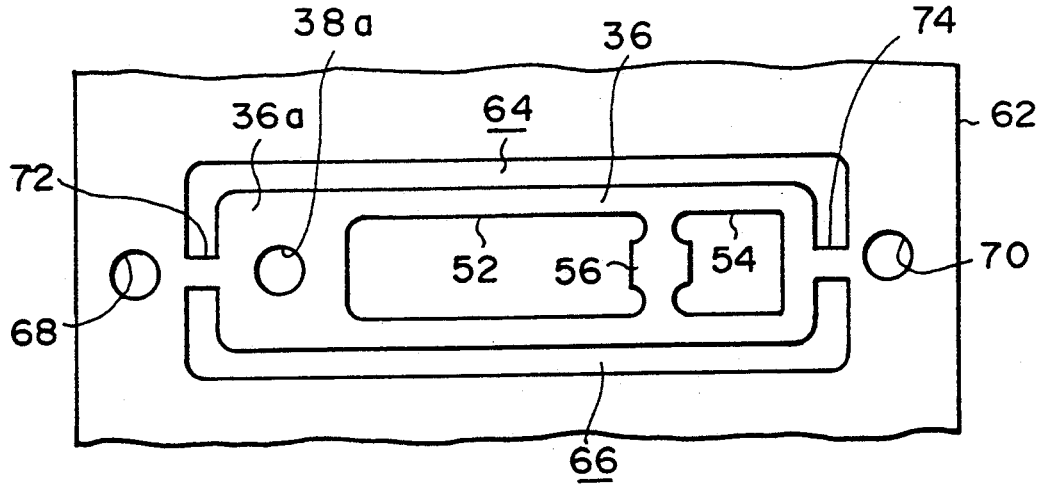
FIG. 13 is a plan view showing the process of fabricating a first movable member according to the third embodiment.
Figure 14:
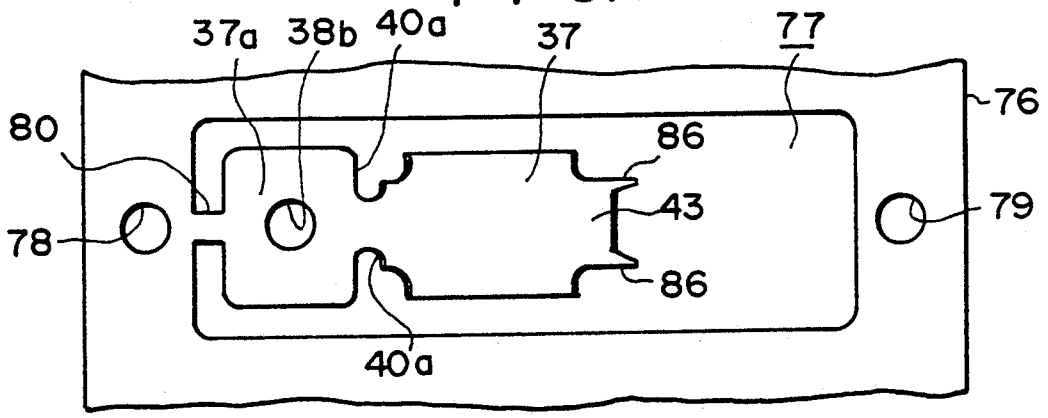
FIG. 14 is a plan view showing the process of fabricating a second movable member according to the third embodiment.
Figure 15:
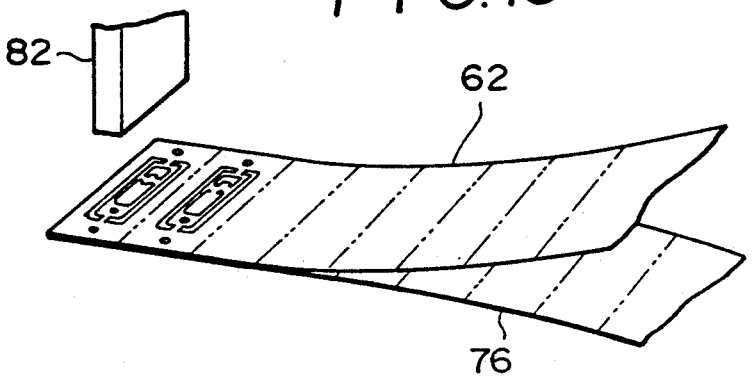
FIG. 15 is a perspective view showing the process of stamping in the third embodiment.
Figure 16:
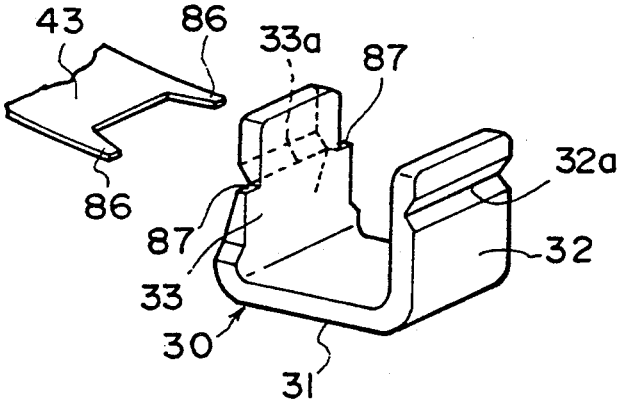
FIG. 16 is a perspective view showing a supporting member according to the third embodiment.

FIGS. 13 through 15 show the process of fabricating the first and second movable members 36 and 37. As shown in FIG. 13, the first movable member 36 is fabricated by subjecting a leaf spring material 62 to stamping to form the long slot 52, the short slot 54, and the circular hole 38*a* for the movable contact, and for punching out U-shaped slits 64 and 66 as well as positioning circular holes 68 and 70. Here, the first movable member 36 is still connected with the leaf spring material 62 via connecting portions 72 and 74 left between the slits 64 and 66.

On the other hand, (see FIG. 14) the second movable member 37 is fabricated by punching out the circular hole 38*b* for the movable contact, a substantially U-shaped slit 77, and positioning circular holes 78 and 79 in a different leaf spring material 76. Here, the second movable member 37 is still connected with the leaf spring material 76 via a connecting portion 80. These movable members 36 and 37 are successively formed in the leaf spring materials 62 and 76, respectively, at certain intervals as shown in FIG. 15.

Figure 9:
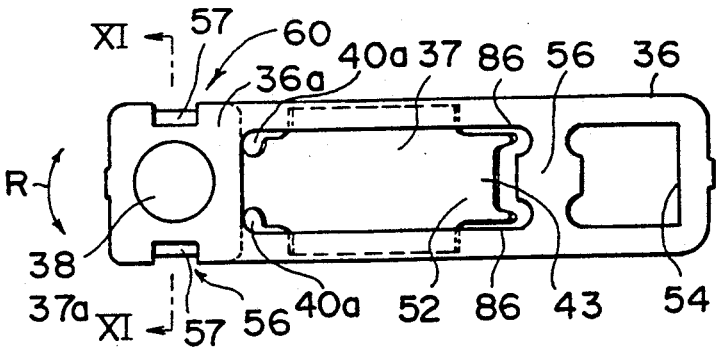
FIG. 9 is a plan view showing a movable member according to the third embodiment.
Figure 10:
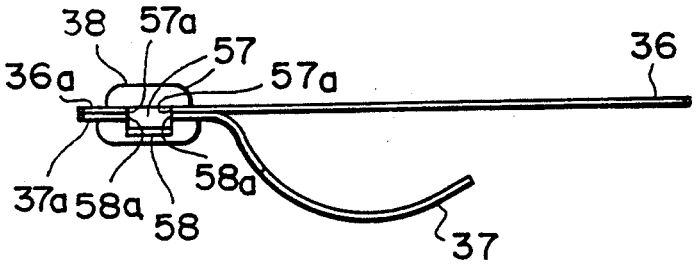
FIG. 10 is a front view showing the movable member of FIG. 9.
Figure 11:
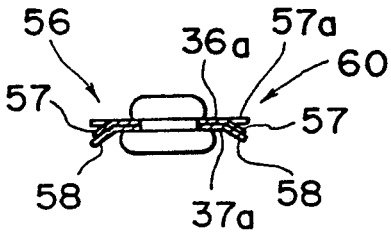
FIG. 11 is a sectional view taken along line XI-XI in FIG. 9.

Then, the leaf spring materials 62 and 76 are superposed as shown in FIG. 15 such that the positioning circular holes 68 and 70 correspond to the positioning holes 78 and 79, respectively, leading to the superposed relationship of FIG. 9. A punch 82 (see FIG. 15) is used to form the shear faces 57*a* and 58*a* in the two movable members 36 and 37 and provide the folded portions 57 and 58 for clamping. Then, the movable contact 38 is caulked to the circular holes 38*a* and 38*b*, and the connecting portions 72, 74 and 80 are cut off, leading to the state of FIG. 9.

In the foregoing process of fabrication, the steps of forming the folded portions 57 and 58, securing the movable contact 38, and cutting off the connecting portions 72, 74 and 80 may be performed in a different order, or performed simultaneously if allowable. The number of folded portions 57, 58 may be changed to one or three or more. Further, the coupling means 60 may be embodied by a combination of protrusions (provided on one of the two movable members 36 and 37) and recesses (formed in the other) instead of the folded portions 57 and 58.

Figure 12:
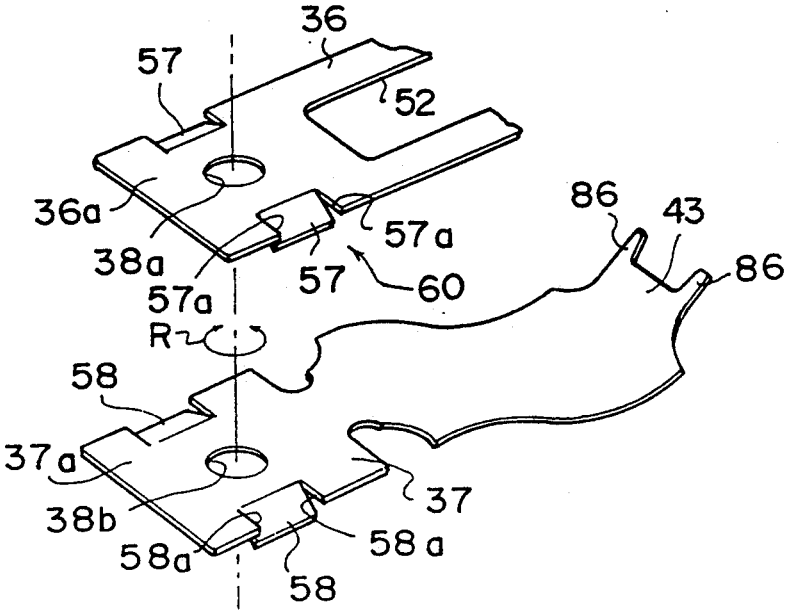
FIG. 12 is a development showing the movable member of FIG. 9.

As shown in FIG. 12, the pivot portion 43 of the second movable member 37 may have projecting portions 86 by which the second movable member 37 is reliably supported on the terminal body 30. Specifically, the projecting portions 86 extend from either end of the pivot portion 43, which are adapted to be engaged with stepped portions 87 formed at either edge of the support portion 33 of the terminal body 30.

Figure 17:
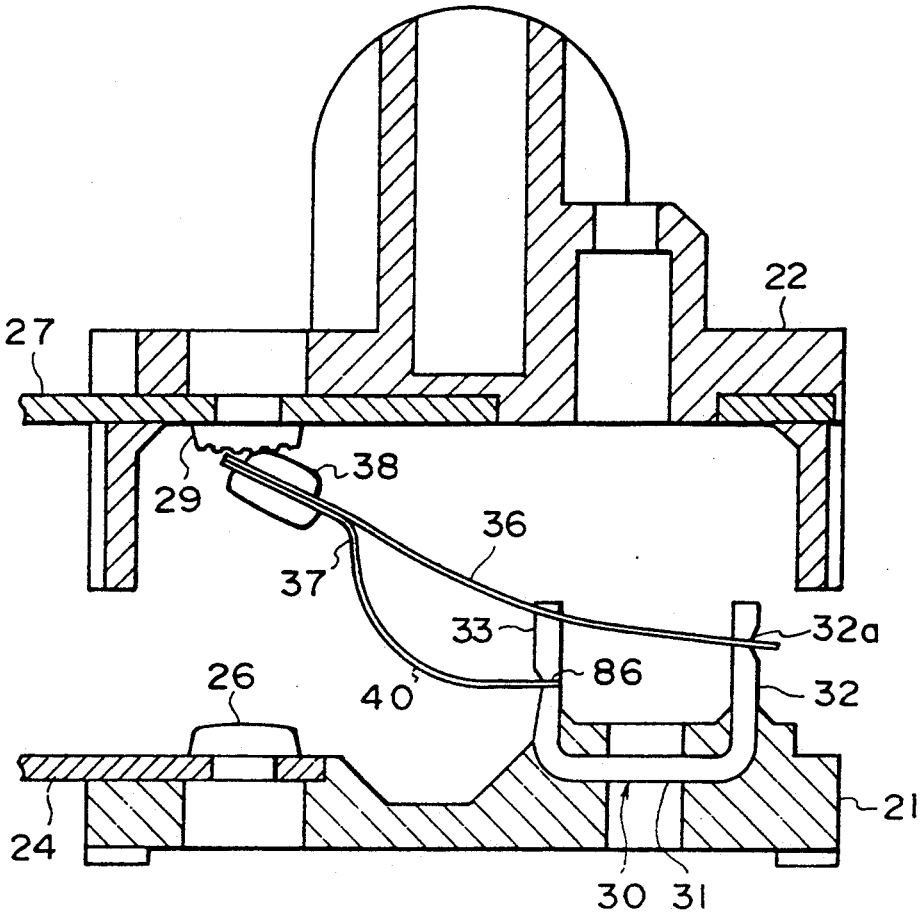
FIG. 17 is a sectional view showing the process of assembling in the third embodiment.

FIG. 17 shows the partly assembled state in which the first and second movable members 36 and 37 are connected together by the movable contact 38, the second movable member 37 has the curved portion 40, the edge portion (the pivot portion) of the short slot 54 of the first movable member 36 is fitted to the lock portion 32*a* of the support portion 32 of the terminal body 30. Leading to the assembled state of FIG. 8, the pivot portion 43 of the second movable member 37 is fitted to the lock portion 33*a* of the support portion 33 of the terminal body 30, so that the movable contact 38 faces upward. The casing 22 is then placed on the base member 21 and secured thereto, so that the movable contact 38 is pressed downward.

In the thus completely assembled state, since the projection portions 86 are always engaged with the stepped portions 87 of the support portion 33, the second movable member 37 is never detached from the terminal body 30.

Figure 18:
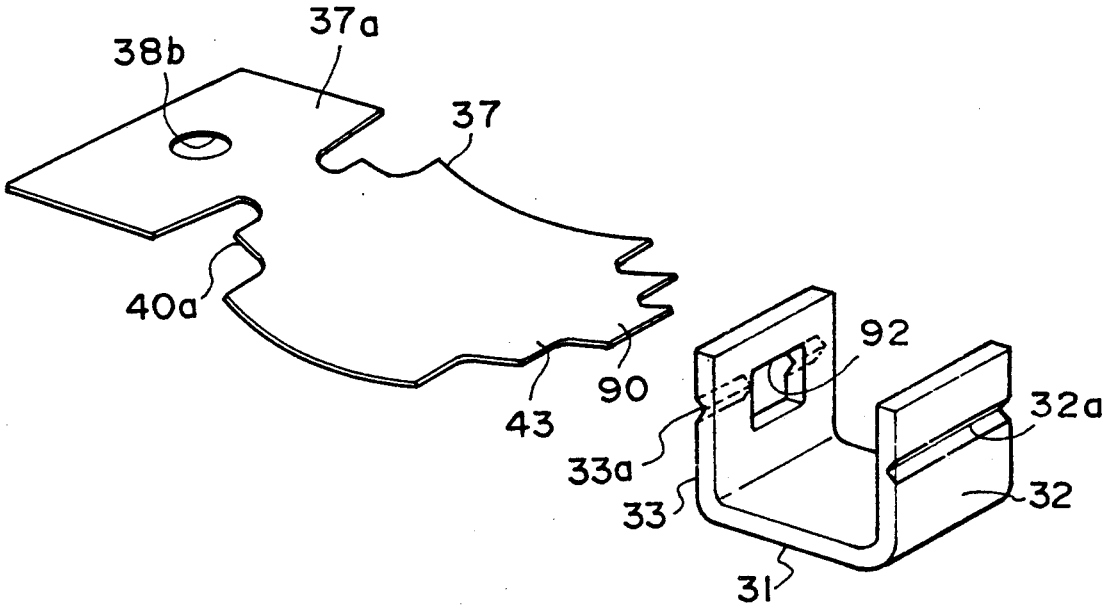
FIG. 18 is an exploded perspective view showing a supporting member and a second movable member according to a fourth embodiment of the present invention.

FIG. 18 shows a fourth embodiment of the present invention, in which a projecting portion 90 extends from a laterally central portion of the pivot portion 43, which is adapted to be inserted into a rectangular slit 92 formed in the support portion 33 of the terminal body 30. Therefore, similar to the third embodiment, the second movable member 37 is reliably supported on the terminal body 30. The present invention should not be limited to the foregoing engaging mechanism, and the mechanism of reliably engaging the first and second movable members 36 and 37 with the terminal body 30 may be embodied by other means.

What is claimed is:

1. A switch device whose state is changed over upon a snap action, comprising:

a) a first movable member made of a leaf spring and having a slot formed in a middle portion thereof, b) a supporting means for swingably supporting a base portion of the first movable member, having a first movable member supporting portion inserted in the slot, c) a second movable member made of a leaf spring and fabricated separately from said first movable member, having a middle portion which has a width greater than the width of said slot, a base portion which is narrower than the slot, and a free end portion which is superposed on a free end portion of the first movable member, the base portion being swingably supported by the supporting means so that upon application of an operating force to the first movable member the second movable member flexes resiliently to cause a snap action to thereby quickly change its urging direction, d) a movable contact secured proximate to the free end portions of the first and second movable members, respectively, e) fixed contacts facing each other and disposed in opposite relation with the movable contact disposed between them, with which the movable contact selectively comes in contact upon the snap action of the second movable member, and f) a coupling means which is provided in the superposed free end portions of the first and second movable members for coupling the first and second movable members together so as to prevent rotational shifting of the first and second movable members, said coupling means being located on opposite sides of said movable contact.

2. A switch device according to claim 1, wherein the movable contact to be secured to the superposed free end portions is a rivet.

3. A switch device according to claim 1, wherein the coupling means includes a protrusion which projects from one of the first and second movable members and engages with the other.

4. A switch device according to claim 3, wherein the protrusion is provided by forming slits with shear faces in one of the first and second movable members and bending a portion of the one movable member that is partly separated by the slits.

5. A switch device according to claim 1, wherein each support portion of the supporting means for supporting the first and second movable members has the form of a groove which extends on a surface of the supporting means in a lateral direction thereof.

6. A switch device according to claim 5, wherein the supporting means includes a pair of arms, wherein respective back-side surfaces of said pair of arms each have one groove.

7. A switch device according to claim 6, wherein the supporting means is made of a plate material having end portions which are bent so as to extend substantially parallel to each other to thereby define the support portions, and a middle portion of the plate material is secured to a switch body.

8. A switch device according to claim 1, wherein a retaining means is provided between the supporting means and the base portion of the second movable member that is supported by the supporting means to prevent the base portion of the second movable member from detaching from the supporting means.

9. A switch device according to claim 8, wherein the retaining means includes projecting portions projecting from the base portion that are adapted to be engaged with the supporting means.

10. A switch device according to claim 9, wherein the supporting means has a stepped portion for receiving the projecting portions so as to restrict movement, in directions orthogonal to the thicknesswise direction, of the base portion.

11. A switch device according to claim 1, wherein the slot of the first movable member is formed in a laterally central portion thereof, and the base portion of the second movable member is formed in a laterally central portion thereof.

12. A switch device according to claim 1, wherein the middle portion of the second movable member is substantially identical in width to the middle portion of the first movable member.

13. A switch device according to claim 1, wherein said middle portion of said second movable member increases the current capacity of the switch device, and provides increased contact pressure of the movable contact.

14. A switch device having a movable contact which is quickly moved between a pair of fixed contacts upon a snap action, comprising:

a) a switch casing to which the fixed contacts are attached, b) a supporting member attached to the switch casing, having two back-side surface and a groove formed on each back-side surface, c) a first movable member having a slot formed in a middle portion thereof into which the supporting member is inserted such that an edge portion of the slot is fitted in one of the grooves, d) a second movable member having a middle portion which has a width greater than the width of said slot, a free end portion connected to a free end portion of the first movable member to define a connecting portion to which the movable contact is secured, and a base portion set in such a width that it can be inserted in the slot and which is fitted in the other groove, wherein said middle portion is adapted to deform resiliently to cause a snap action to thereby generate an urging force such that the movable contact comes in contact with one or the other of the fixed contacts, and e) a coupling means which is provided in the connecting portion of the first and second movable members for coupling the first and second movable members so as to prevent rotational shifting of the first and second movable members, said coupling means being located on opposite sides of said movable contact.

15. A switch device according to claim 14, wherein the free end portions of the first and second movable members, respectively, are superposed on each other and secured together.

16. A switch device according to claim 15, wherein the movable contact is secured to the thus superposed free end portions of the first and second movable members.

17. A switch device according to claim 16, wherein the movable contact acts as a rivet to keep the thus superposed state.

18. A switch device according to claim 14, wherein the slot and the base portion of the second movable member are formed in respective laterally central portions of the first and second movable members.

19. A switch device according to claim 14, wherein the supporting means includes a pair of arms projecting from the switch casing, which are inserted in the slot and have respective grooves formed therein.

20. A switch device according to claim 19, wherein the supporting means has a substantial 1 U-shape, and a central portion is secured to the switch casing.

21. A switch device according to claim 14, wherein the middle portion of the second movable member is substantially identical in width to the middle portion of the first movable member.

22. A switch device comprising:

a) a switch casing, b) a supporting member having a central portion secured to the switch casing and end arms projecting substantially parallel to each other, c) a first leaf spring having a slot formed in a middle portion thereof, into which the two end arms of the supporting member are inserted, and swingably supported by one of the end arms, d) a second leaf spring having a middle portion which has a width greater than the width of said slot, a free end portion which is connected with a free end portion of the first leaf spring, and a base end portion which is narrower than the slot and is pressed by the other end arm to deform resiliently to thereby cause snap action, e) a movable contact for securing the free end portion of the first and second leaf springs, respectively, together in superposed form, f) a pair of fixed contacts spaced away from each other with the movable contact disposed between them, on which the movable contact selectively abuts, and g) a coupling means which is provided in the connected free end portions of the first and second movable members for coupling the first and second movable members together so as to prevent rotational shifting of the first and second movable members, said coupling means being located on opposite sides of said movable contact.

23. A switch device according to claim 22, wherein the middle portion of the second leaf spring is substantially identical in width to the middle portion of the first leaf spring.

* * * * *